US006210807B1

(12) United States Patent
Dong et al.

(10) Patent No.: US 6,210,807 B1
(45) Date of Patent: Apr. 3, 2001

(54) SURFACE OXIDATION OF A TITANIUM OR TITANIUM ALLOY ARTICLE

(75) Inventors: Hanshan Dong, Birmingham; Andrew Bloyce, Worcestershire; Peter Harlow Morton, West Midlands; Thomas Bell, Merseyside, all of (GB)

(73) Assignee: The University of Birmingham, Birmingham (GB)

( * ) Notice: Subject to any disclaimer, the term of this patent is extended or adjusted under 35 U.S.C. 154(b) by 0 days.

(21) Appl. No.: 09/214,874

(22) PCT Filed: Jul. 14, 1997

(86) PCT No.: PCT/GB97/01902

§ 371 Date: Sep. 13, 1999

§ 102(e) Date: Sep. 13, 1999

(87) PCT Pub. No.: WO98/02595

PCT Pub. Date: Jan. 22, 1998

(30) Foreign Application Priority Data

Jul. 17, 1996 (GB) ..... 9614967

(51) Int. Cl.[7] ..... B32B 9/00; B32B 15/04

(52) U.S. Cl. ..... 428/472; 148/281; 427/377; 427/380

(58) Field of Search ..... 428/472; 148/281; 427/377, 380

(56) References Cited

U.S. PATENT DOCUMENTS

| | | | | |
|---|---|---|---|---|
| 3,408,236 | | 10/1968 | Van Hartesveldt . | |
| 4,263,060 | | 4/1981 | Gaucher et al. . | |
| 4,687,487 | * | 8/1987 | Hinterman | 623/18 |
| 4,857,269 | * | 8/1989 | Wang et al. | 420/417 |
| 5,051,140 | * | 9/1991 | Mushiake et al. | 148/203 |
| 5,169,597 | * | 12/1992 | Davidson et al. | 428/613 |
| 5,372,660 | | 12/1994 | Davidson et al. . | |

FOREIGN PATENT DOCUMENTS

| | | |
|---|---|---|
| 0244253 | 11/1987 | (EP) . |
| WO9509932 A1 | 4/1995 | (WO) . |
| WO9623908 | 8/1996 | (WO) . |

* cited by examiner

*Primary Examiner*—Deborah Jones
*Assistant Examiner*—Lymarie Miranda
(74) *Attorney, Agent, or Firm*—Cantor Colburn LLP

(57) ABSTRACT

The tribological behavior of titanium or titanium alloy article is improved by gaseous oxidation of the article at a temperature in the range of 500 to 725° C. for 0.5 to 100 hours, the temperature and time being selected such as to produce an adherent surface compound layer containing at least 50% by weight of oxides of titanium having a rutile structure and a thickness of 0.2 to 2 μm on a solid solution-strengthened diffusion zone wherein the diffusing element is oxygen and the diffusion zone has a depth of 5 to 50 μm.

10 Claims, 4 Drawing Sheets

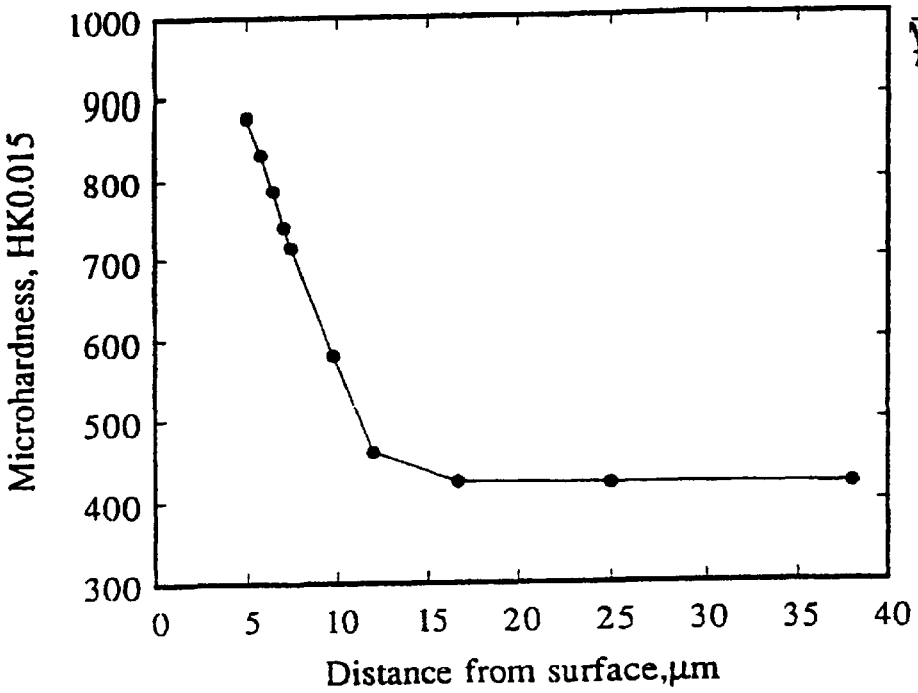
Fig.1
Fig.2
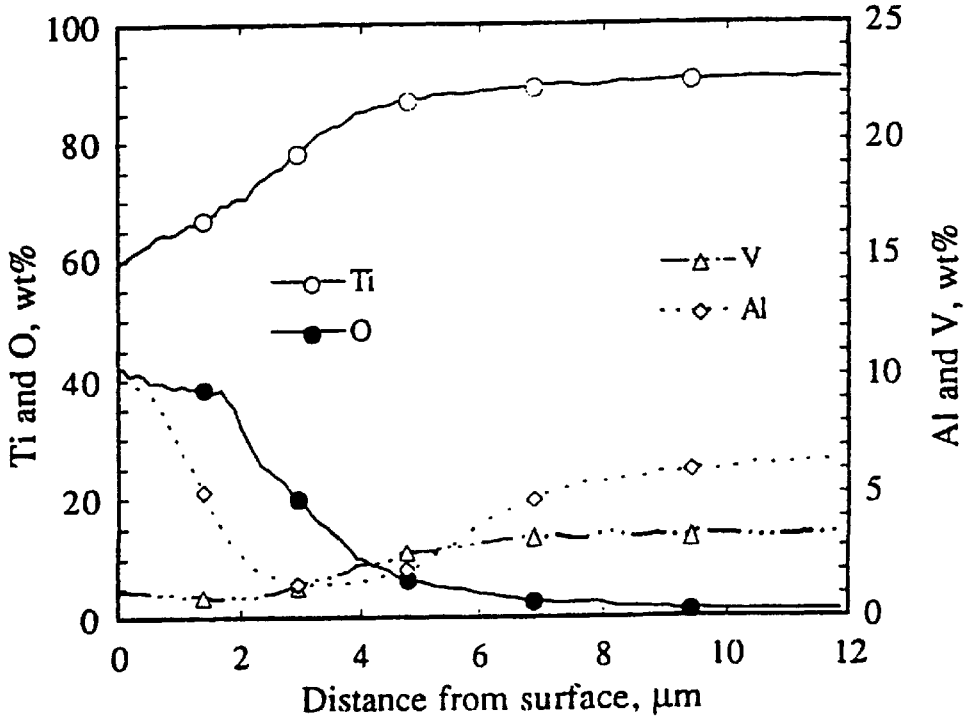

SURFACE OXIDATION OF A TITANIUM OR TITANIUM ALLOY ARTICLE

BACKGROUND OF THE INVENTION

This invention relates to a process for the surface treatment of titanium and titanium alloys for the purpose of improving the tribological properties thereof, and also relates to surface-treated titanium and titanium alloys having improved tribological properties and uses for such surface-treated titanium and titanium alloys.

Over the past forty years, there have been many investigations into the effect of surface treatment of titanium and titanium alloys on surface hardness. A great deal of work has been devoted to the study of oxidation of titanium and its alloys which is generally viewed as a problem when surface treating titanium and its alloys in various gaseous environments. Little attention has been paid to tile deliberate oxidation of titanium alloys for use as a tribological surface treatment. Investigations have been reported in various journals over a long period of time. H. W. Worner in "Surface Hardening of Titanium", The Australasian Engineer, November 1950, pages 52 to 55, observed that, when commercially pure titanium was heated in the range of 850 to 1000° C. in air at a pressure of between $10^{-3}$ mm and $10^{-2}$ mm Hg, the surface was effectively hardened. However, R. W. Hanzel in "Surface Hardening Processes for Titanium and its Alloys", Metal Progress, March 1954 pages 89 to 96 discounted the commercial utility of such process since, at a temperature high enough to achieve an appreciable hardening effect, a considerable amount of scale is formed and the fatigue strength is also reduced. At the other end of the temperature scale, it was subsequently shown that the coefficient of friction of commercially pure titanium markedly decreases when it is heated in air at 350° C. for 17 hours; it was also shown that the coefficient of friction of the oxidised surface of titanium remains low after removal of brittle compound layers (see E. S. Machlin et al, Journal of Applied Physics, Vol 25, 1954 pages 576 to 581 and W. R. Yankee, "Influence of Oxygen and Nitrogen in Solution in Alpha Titanium on the Friction Coefficient of Copper on Titanium", Transactions AIME, September 1954 pages 989 to 990). However, such a procedure is costly since it requires the additional step of removal of such brittle layers.

In view of the difficulties associated with the severe scaling of titanium alloys when heated in air, the possibility of controlled oxidising in molten salts has been investigated. When titanium specimens are heated in lithium carbonate salt baths at temperatures between 600 and 900° C. for 2 to 4 hours, satisfactory layers are said to be formed. The technique has been used for the production of batches of titanium pistons, as disclosed by E. Mitchell et al in, "Surface Treatments for Improving the Wear Resistance and Friction Properties of Titanium and its Alloys", journal of the Institute of Metals, Vol 93 1964/65, pages 381 to 386. Also, JP-A-56-146875 (Patent Abstracts of Japan, Vol 6, No. 24 (C-91) Feb. 12, 1982) discloses the formation of stable titanium oxide on a titanium material by burying the material in magnesium oxide or aluminium oxide and heating at 550 to 850° C. in air.

The so-called Tifran process (see A. Goucher et al, "Nouvelles Possibilites de Frottement des Alliages de Titane: Le Tifran," Entropie, No. 63, 1975, pages 36–41) has been used to treat Ti-6Al-4V and involves gaseous oxidation of the titanium alloy at 750° C. for 10 hours to produce a case depth of about 50 μm. The process is reported to result in a surface layer having a titanium oxide base, and a diffusion zone. However, such process parameters produce a porous poorly adherent oxide layer and carry with them the risk that components of complex geometry would be distorted. In another form of the Tifran process, the titanium alloy is oxidised at 630° C. for 3 hours. However, this produces a titanium dioxide layer of negligible thickness.

R. M. Streicher et al, "New Surface Modification for Ti-6Al-7Nb alloy: Oxygen Diffusion Hardening (ODH)", Biomaterials, Vol 12, 1991 pages 125–129 disclose graded oxygen diffusion hardening to a depth of 50 μm with a maximum hardness of 900 HV compared with 360 HV for the untreated alloy. The ODH-treated alloy is claimed to have improved friction and wear resistance and to be useful in surgical prostheses. The corrosion resistance of the ODH-treated titanium alloy is claimed to be equal to that of commercially pure titanium and the untreated alloy. However, no parameters are described and the micrographs show no evidence of a $TiO_2$ layer of a dimension with which the present invention is concerned.

M. Mushiake et al, "Development of Titanium Alloy Valve Spring Retainers", SAE Technical Report Series No. 910428, 1991 pages 41 to 49, disclose a wear-resistant surface treatment based on air oxidation to protect valve spring retainers made of Ti-22V4Al β titanium alloys. A better wear resistance is said to be afforded to the component by using the oxidation process treatment as compared with either ion nitriding or gas carburising. M. Mushiake et al disclose that oxidation at 850° C. for 30 minutes of such titanium alloy valve spring retainers imparts a better wear resistance than that of steel retainers. However, this process is not applicable to α or α+β alloys since it alters the bulk microstructure, degrades the properties and risks causing problems of distortion, particularly for components of complex geometry.

WO95/09932 discloses the oxidation of a titanium alloy product to improve tribological properties by a procedure which involves deep surface hardening to a depth of greater than 100 μm by localised surface re-melting without further alloying, optionally surface finishing the deep surface hardened material, oxidising to a depth of less than 100 μm (usually less than 50 μm and preferably in the range of 1–20 μm), followed by modification of residual stress by shot peening or heat treatment. The above treatment improves rolling contact fatigue resistance and scuffing resistance. Thermal oxidation of the alloy product in air at 600 to 850° C. produces layers of oxide and oxide-rich Ti at the surface. In one particular example, thermal oxidation in an air-circulation furnace for 10 hours at 650° C. is performed as part of the previously described processing sequence which results in a very substantial improvement in wear resistance as compared with the completely untreated material.

A. K. Mishra et al ("Diffusion Hardening—A New Surface Hardening Process for Titanium Alloys", Surface Modification Technologies VII, The Institute of Materials, 1994 pages 453–471) refer in general terms to a procedure for diffusion hardening a Ti-13Nb-13Zr alloy which involves using a proprietary treatment in an atmosphere containing atomic oxygen, but without giving any process details. Treated specimens are said to have a 0.7 μm surface layer comprised of ceramic oxides such as $ZrO_2$, $TiO_2$ and $Nb_2O_5$ with an oxygen penetration depth of 2–3 μm, and an increased surface hardness and abrasion resistance It is an object of the present invention to provide an improved oxidation treatment which is simple to operate and which can produce titanium or titanium alloys having improved tribological properties such that the treated material is suitable for use in a relatively wide variety of applications.

SUMMARY OF THE INVENTION

According to one aspect of the present invention, there is provided a process for improving the tribological behaviour of a titanium or titanium alloy article, comprising gaseous oxidation of the article at a temperature in the range of 500 to 725° C. for 0.1 to 100 hours, the temperature and time being selected such as to produce an adherent surface compound layer containing at least 50% by weight of oxides of titanium having a rutile structure and a thickness of 0.2 to 2 μm on a solid solution-strengthened diffusion zone wherein the diffusing element is oxygen and the diffusion zone has a depth of 5 to 50 μm.

According to another aspect of the present invention, there is provided a titanium or titanium alloy article having (i) an adherent 0.2–2 μm thick surface compound layer containing at least 50% by weight of oxides of titanium having a rutile structure, and (ii) a solid-solution strengthened oxygen diffusion zone having a depth of 5 to 50 μm.

The gaseous oxidation treatment is preferably effected for at least 0.5 hours. It is to be appreciated that, whilst the treatment procedure is within the above specified time and temperature ranges, not all combinations of these times and temperatures will produce the required surface compound layer and oxygen diffusion zone. The gaseous oxidation treatment may be effected for 60 to 100 hours at 580 to 620° C. For example, such treatment may be effected for about 75 to 100 hours (preferably about 75 hours) at about 600° C. Alternatively, the treatment may be effected at about 660–700° C. for about 0.1 to 8 hours. For example, treatment (a) for about 0.1 to 2.5 hours at about 700° C. (treatment for 2.5 hours at 700° C. produces a surface compound layer having a thickness of about 1 μm and an oxygen diffusion zone having a depth of about 10 μm); or (b) for about 0.1 to 5 hours, preferably about 5 hours at about 680° C.

The gaseous oxidising atmosphere may be an atmosphere having an oxygen partial pressure of 0.1 to 1. This may be achieved under a reduced pressure or under normal atmospheric pressure. Conveniently, the gaseous atmosphere is air (oxygen partial pressure=0.2)

More preferably, the surface compound layer has a thickness of 0.5 to 2 μm.

In contrast to WO95/09932, articles which have been oxidised in accordance with the present invention are ready for use without any additional treatment operations thereon.

The invention is applicable to commercially pure grades of titanium and to titanium alloys (α, α+β, or β alloys). Amongst the titanium alloys which may be used is Ti-6Al-4V. Articles formed of alloys of this type which have been oxidised in accordance with the present invention include valve spring retainers for use in internal combustion engines, e.g. for automotives; balls for ball valves; disks and seats for butterfly valves; domestic and industrial cooking utensils, such as saucepans, frying pans and griddles; and wire ropes. Articles formed of commercially pure grades of titanium oxidised in accordance with the present invention include those listed above apart from automotive valve spring retainers for which Ti-6Al-4V is particularly suited.

In the method of the present invention, the article to be oxidised can simply be placed in a cold or pre-heated furnace and subjected to the specified thermal cycle whilst maintaining a gaseous oxidising atmosphere, e.g. air, in the furnace. Following treatment, the article can be furnace-cooled and is then ready for use without any further treatment.

The treated articles, in addition to having a low coefficient of friction and good resistance to sliding wear against metal or non-metal counterfaces both lubricated and un-lubricated, but especially under lubricated conditions, even with $H_2O$ as the lubricant, are considered to possess good "non-stick" properties.

For certain applications, it may be desirable to subject the resultant treated articles to a per se known shot peening operation to improve fatigue properties.

BRIEF DESCRIPTION OF THE DRAWINGS

In the accompanying drawings:

FIGS. 1 to 6 are graphs showing the properties of untreated testpieces and testpieces treated in accordance with the present invention.

DESCRIPTION OF THE PREFERRED EMBODIMENTS

In order to demonstrate the advantages of the present invention, titanium alloy testpieces formed of Ti-6Al-4V were placed in a cold furnace containing air and heated for 100 hours at 600° C., followed by furnace cooling. The resultant testpieces will be referred to hereinafter as the "TO treated" testpieces. The TO treated testpieces had a surface compound layer which had a thickness of about 2 μm and which was formed mainly of $TiO_2$ of rutile structure. Below the thin surface compound layer, there was an oxygen diffusion zone forming a hardened layer extending down to a depth of about 15 μm. The oxygen concentration of such diffusion zone reduced with depth. These features of the TO treated testpiece will be apparent from FIG. 1 which is a graph plotting micro-hardness against distance from the surface in micrometers, and from FIG. 2 which is a graph plotting the titanium and oxygen contents in wt % at various distances from the surface in μm.

Figure 3:
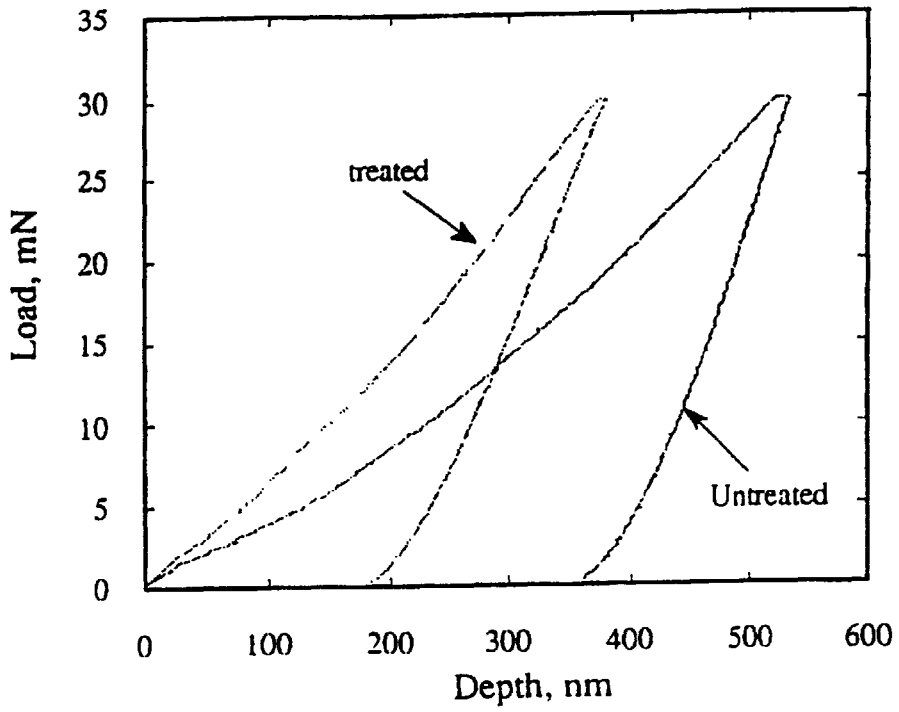

In nano-indentation tests to assess the mechanical properties of the surface compound layer, the TO treated testpieces had a Hardness Ratio of 2.5, an Elastic Recovery of 40.6 and an E/H ratio of 13.8, as compared with a Hardness Ratio of 1, an Elastic Recovery of 18.3% and an E/H ratio of 26.9 for untreated testpieces. The hardness ratio indicates that the surface compound layer on the TO treated testpieces has a hardness of about 10,000 MPa (approximately 1000 HV). FIG. 3 is a graph in which load in mN is plotted against depth in nm for the TO treated and un-treated testpieces. The load versus depth hysteresis curves in the graph of FIG. 3 demonstrate that the oxide layer of the TO treated testpiece exhibits a much shallower penetration depth and a higher elastic recovery compared to the un-treated testpiece.

X-ray diffraction data indicates that the surface compound layer is essentially $TiO_2$-rutile.

Figure 4:
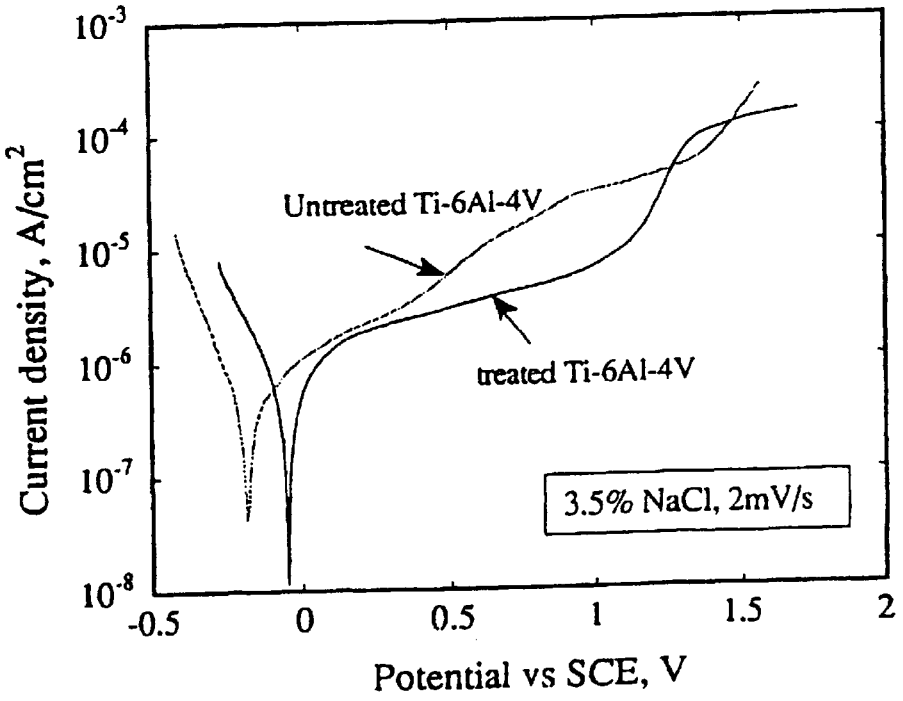

TO treated and untreated testpieces were subjected to corrosion tests. FIG. 4 shows anodic polarisation curves of the un-treated and TO treated Ti-6Al-4V testpieces and reveals that, after passing through the transition potential, the corrosion currents for both the TO treated and untreated testpieces first increase rapidly and then show a passivation stage before rising sharply again. The TO treated testpiece has a lower corrosion current and a more positive transition potential, indicating that it has at least as good a corrosion resistance as the untreated testpiece, which may be attributed to the dense oxide layer.

Figure 5:
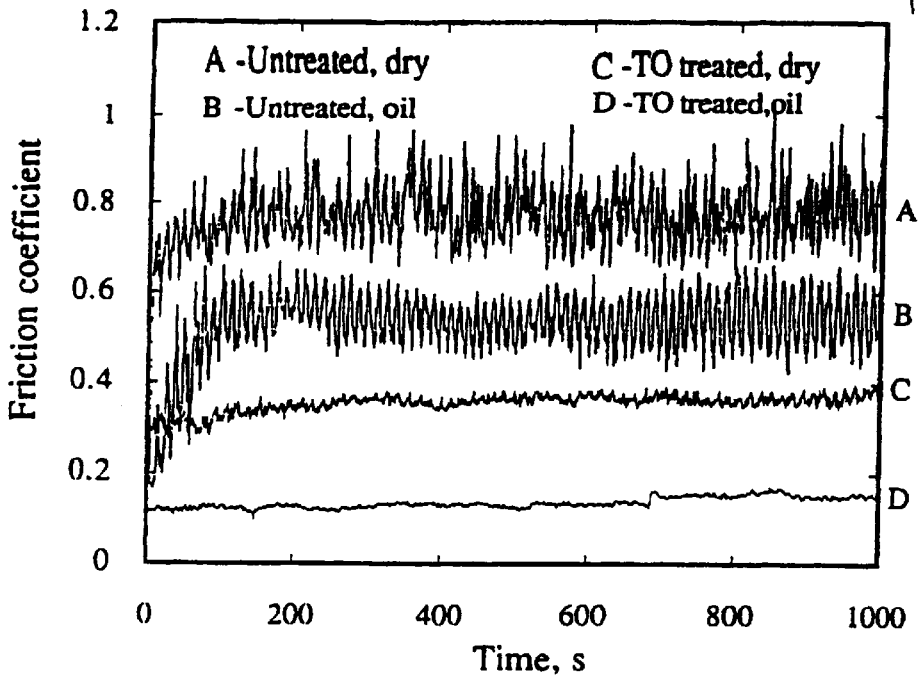

FIG. 5 shows friction coefficient traces for TO treated and un-treated Ti-6Al-4V testpieces against alumina balls under both oil-lubricated and dry wear conditions. It can be seen that the friction coefficient of the TO treated testpiece is reduced and is more stable than that of the un-treated material both under dry and oil-lubricated wear conditions.

Figure 6:
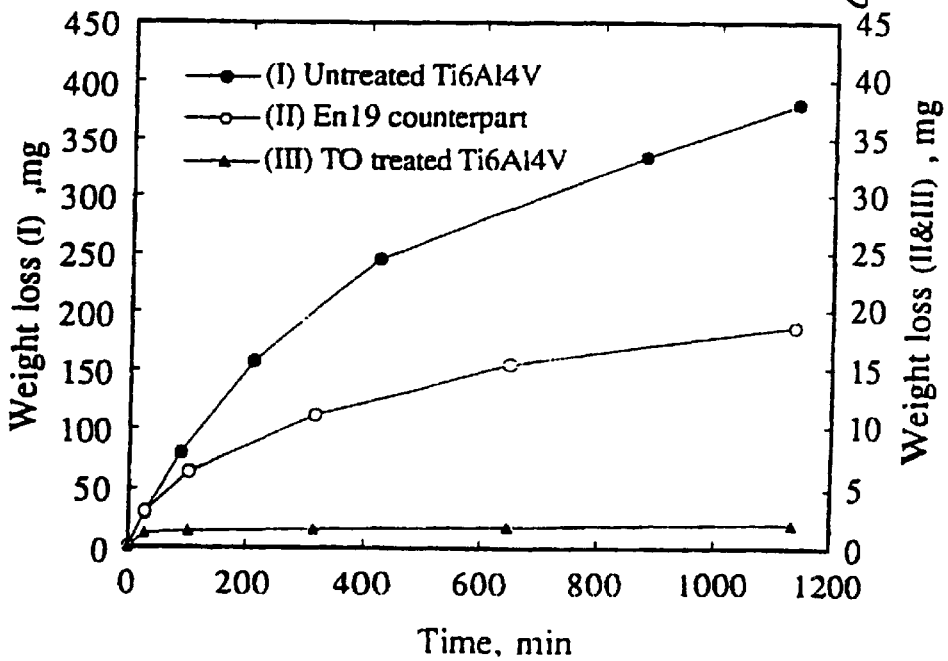

FIG. 6 shows wear resistance plotted as weight loss in mg against time in lubricated sliding-rolling wear tests. The steady state wear rates measured in such tests were $1.67\times10^{-1}$, $9.7\times10^{-3}$ and $9.5\times10^{-4}$ mg/min for untreated Ti-6Al-4V, an EN19 counterpart, and the TO treated Ti-6A-4V, respectively. As can be seen from FIG. 6, the wear rate of the TO treated testpiece was dramatically reduced by more than two orders of magnitude as compared with the un-treated testpiece and was even lower than that of hardened EN19 steel by a factor of more than 10.

Figure 7:
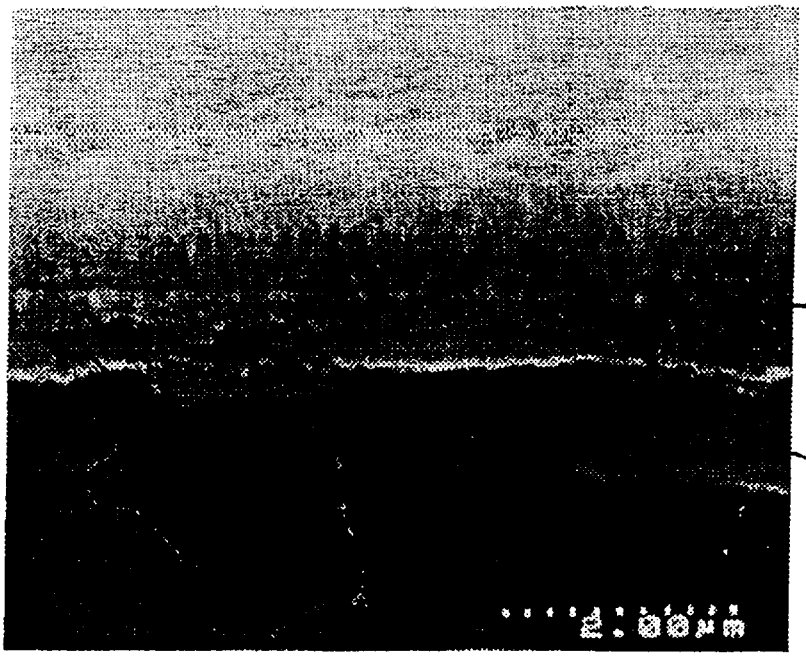
FIGS. 7 and 8 are optical micrographs of testpieces treated in accordance with the present invention.
Figure 8:
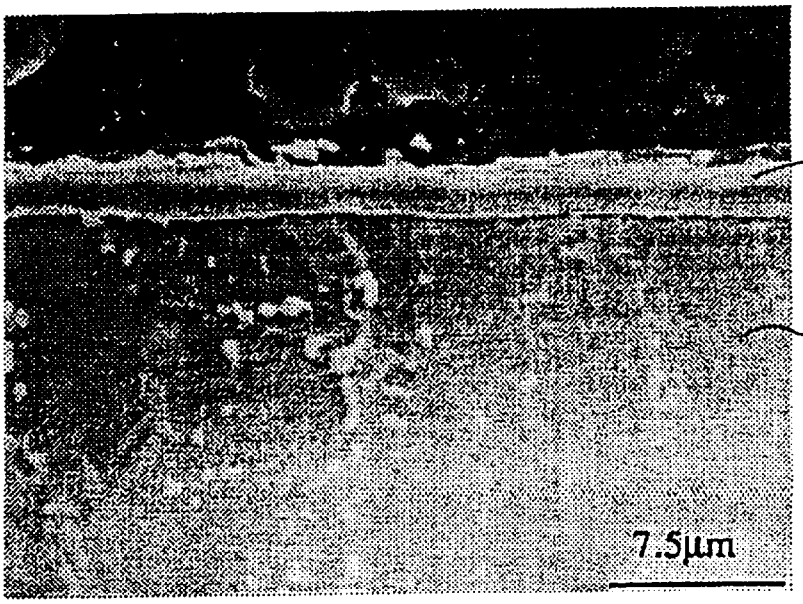

FIG. 7 is an optical micrograph of a fracture section of a TO treated testpiece treated as described above where the surface compound layer is indicated by the reference numeral 10 and the substrate is indicated by the reference numeral 12. It can be seen that no delamination has occurred between the surface compound layer 10 and the substrate 12, thus showing that the surface compound layer is adherent and dense. FIG. 8 is another optical micrograph showing the density, adhesion and uniformity of the surface compound layer 10 on the substrate 12 of the TO treated testpiece.

In a further series of experiments, testpieces of Ti-6Al-4V were TO treated as described above at various temperatures and for various times as shown in the Table below where the oxide layer thicknesses and diffusion zone depths resulting from such treatments are also shown.

TABLE

| Run No. | Time (hr) | Temp. (° C.) | Oxide Layer Thickness (μm) | Diffusion Zone Depth (μm) |
|---|---|---|---|---|
| 1 | 50 | 600 | 1.4 | 10.6 |
| 2 | 100 | 600 | 2 | 14 |
| 3 | 3 | 630 | 0.2 | 4 |
| 4 | 10 | 650 | 1 | 8 |
| 5 | 2.5 | 700 | 1 | 10 |
| 6* | 20 | 680 | 8 | 20 |
| 7* | 8 | 700 | 6 | 15 |
| 8* | 20 | 700 | 10 | 27 |
| 9* | 48 | 700 | 15 | 45 |

In the above Table, the diffusion zone depth was assessed by examining the response to etching after polishing. The transition between the diffusion zone and the underlying bulk material correlates to a drop of about 10% in hardness which gives a recognisably different response to etching.

In a further series of experiments, small test pieces of butterfly valve discs cast in unalloyed titanium were TO treated as described above at 600° C. for 25, 50, 75 and 100 hours. A load bearing wear test against the TO treated pieces and an untreated test piece showed that all the TO treated samples had an increased load bearing capacity but that the sample treated for 75 hours had the best combination of adherent oxide layer and load bearing capacity.

What is claimed is:

1. A process for improving the tribological behavior of a titanium or titanium alloy article, comprising gaseous oxidation of the article at a temperature in the range of 580 to 620° C. for 50 to 100 hours, the temperature and time being selected such as to produce an adherent surface compound layer containing at least 50% by weight of oxides of titanium having a rutile structure and a thickness of 0.2 to 2 μm on a solid solution-strengthened diffusion zone wherein the diffusing element is oxygen and the diffusion zone has a depth of 5 to 50 μm.

2. A process as claimed in claim 1, wherein the gaseous oxidation treatment is effected for 60 to 100 hours.

3. A process as claimed in claim 1, wherein the gaseous oxidation treatment is effected for about 75 to 100 hours at about 600° C.

4. A process as claimed in claim 1, wherein the gaseous oxidation treatment is effected at about 600° C. for about 75 hours.

5. A process as claimed in claim 1, wherein the gaseous oxidation treatment is effected for about 0.1 to 5 hours at about 680° C.

6. A process as claimed in claim 1, wherein the gaseous oxidising atmosphere has an oxygen partial pressure of 0.1 to 1.

7. A process as claimed in claim 4, wherein the gaseous atmosphere is air.

8. A process as claimed in claim 1, wherein the surface compound layer has a thickness of 0.5 to 2 μm.

9. A process as claimed in claim 1, wherein the article is formed of a material selected from the group consisting of commercially pure grades of titanium, α-titanium alloys, α+β-titanium alloys and β-titanium alloys.

10. A process as claimed in claim 1, further including the step of shot peening the resultant treated article.

* * * * *